US008695301B2

(12) United States Patent
Lutkajtis et al.

(10) Patent No.: US 8,695,301 B2
(45) Date of Patent: Apr. 15, 2014

(54) BUILDING SUPPORT SYSTEM

(75) Inventors: Michael Lutkajtis, Double Bay (AU); Rikard Henrik Lutkajtis, Punch Bowl (AU)

(73) Assignee: Vilno Group Pty Ltd, Morrebank, New South Wales (AU)

( * ) Notice: Subject to any disclaimer, the term of this patent is extended or adjusted under 35 U.S.C. 154(b) by 177 days.

(21) Appl. No.: 12/841,129

(22) Filed: Jul. 21, 2010

(65) Prior Publication Data

US 2011/0041451 A1 Feb. 24, 2011

(30) Foreign Application Priority Data

Jul. 21, 2009 (AU) ..... 2009903413

(51) Int. Cl.
*E04B 1/74* (2006.01)

(52) U.S. Cl.
USPC ..... 52/410; 52/404.3; 52/404.5; 52/90.1; 52/92.2; 52/404.2

(58) Field of Classification Search
USPC ..... 52/90.1, 92.1, 22, 404.2, 404.3, 404.5, 52/410, 364, 704, 745.11
See application file for complete search history.

(56) References Cited

U.S. PATENT DOCUMENTS

| | | | | | |
|---|---|---|---|---|---|
| 1,046,874 | A | * | 12/1912 | Ls Sherwood | 403/189 |
| 1,765,791 | A | * | 6/1930 | Fokker | 244/132 |
| 2,256,961 | A | * | 9/1941 | Pearson et al. | 52/407.4 |
| 2,501,746 | A | * | 3/1950 | Shoenberg | 248/188 |
| 2,527,253 | A | * | 10/1950 | Hedfield et al. | 248/239 |
| 3,362,056 | A | * | 1/1968 | Preller et al. | 29/897.35 |
| 3,982,360 | A | * | 9/1976 | Newman | 52/22 |
| 4,060,020 | A | * | 11/1977 | Poliak | 411/417 |
| 4,165,673 | A | * | 8/1979 | Shue et al. | 411/176 |
| 4,177,615 | A | * | 12/1979 | Anderson | 52/478 |
| 4,329,823 | A | | 5/1982 | Simpson | |
| 4,525,967 | A | | 7/1985 | Simpson | |
| 4,528,789 | A | * | 7/1985 | Simpson | 52/404.3 |
| 4,591,023 | A | * | 5/1986 | Hodson | 182/200 |
| 4,593,509 | A | * | 6/1986 | Linton | 52/262 |
| 4,651,489 | A | * | 3/1987 | Hodges et al. | 52/409 |
| 4,761,928 | A | * | 8/1988 | Pichette | 52/404.2 |
| 4,963,062 | A | * | 10/1990 | Giannuzzi | 411/45 |
| 5,010,706 | A | * | 4/1991 | Sauder | 52/404.5 |
| 5,012,938 | A | * | 5/1991 | King | 211/191 |
| 5,095,673 | A | * | 3/1992 | Ward | 52/404.2 |
| 5,163,225 | A | * | 11/1992 | Goleby | 29/897.35 |
| 5,501,053 | A | * | 3/1996 | Goleby | 52/842 |
| 5,692,353 | A | * | 12/1997 | Bass et al. | 52/653.1 |
| 5,772,094 | A | * | 6/1998 | Kaiser et al. | 225/91 |
| 5,857,292 | A | * | 1/1999 | Simpson | 52/22 |
| 6,363,684 | B1 | * | 4/2002 | Alderman et al. | 52/742.12 |
| 6,367,219 | B1 | * | 4/2002 | Quinlan | 52/506.06 |

(Continued)

FOREIGN PATENT DOCUMENTS

| | | | | |
|---|---|---|---|---|
| DE | 3904036 | A1 * | 8/1990 | E04B 1/38 |

*Primary Examiner* — Robert Canfield
*Assistant Examiner* — Matthew Gitlin
(74) *Attorney, Agent, or Firm* — Knobbe, Martens, Olson & Bear, LLP

(57) ABSTRACT

A roofing support system includes a spacer bracket having a lower edge adapted to pierce through a layer of insulation to abut in direct contact with a purlin, a fastener that fastens the spacer bracket to the purlin, and an upper portion adapted to support a beam above the insulation layer and in spaced relationship to the purlin.

11 Claims, 18 Drawing Sheets

(56) References Cited

U.S. PATENT DOCUMENTS

| | | | | |
|---|---|---|---|---|
| 6,470,644 | B2 * | 10/2002 | James et al. | 52/745.06 |
| 6,694,693 | B2 * | 2/2004 | Alderman | 52/478 |
| 7,415,803 | B2 * | 8/2008 | Bronner | 52/378 |
| 7,520,103 | B1 * | 4/2009 | Kelly et al. | 52/748.1 |
| 7,562,500 | B2 * | 7/2009 | Siu | 52/236.6 |
| 7,591,112 | B2 * | 9/2009 | Verheyen | 52/407.2 |
| 7,946,089 | B2 * | 5/2011 | LaLonde | 52/506.07 |
| 7,985,042 | B1 * | 7/2011 | Paxton | 411/527 |
| 2007/0080256 | A1 * | 4/2007 | Collins | 242/598.6 |

* cited by examiner

| | Intended total R-Value | | | Real total R-Value | |
|---|---|---|---|---|---|
| **SYSTEM** | SUMMER | WINTER | **Thermal Break** | SUMMER | WINTER |
| No Spacer | 3.2 | 2.9 | **N** | **1.96** | **1.75** |
| Timber Block | 3.2 | 2.9 | Y | 3.00 | 2.73 |
| Roof Razor | 3.2 | 2.9 | **Y** | **3.19** | **2.88** |
| RoofRazor C3 | 3.2 | 2.9 | Y | 3.18 | 2.87 |

FIGURE 17

BUILDING SUPPORT SYSTEM

RELATED APPLICATION

This application claims the benefit of Australian Patent Application No. 2009903413 filed Jul. 21, 2009, which is hereby expressly incorporated by reference in its entirety.

FIELD OF THE INVENTION

This invention relates to a building support system (such as for supporting roof, wall and/or floor panels) and a method of installing a support system. More particularly, but not exclusively, the invention relates to an insulation spacer for metal roofing, which in effect raises the height of purlins to which the metal roofing is to be attached so as to accommodate insulation under the roofing for improved energy efficiency.

BACKGROUND OF THE INVENTION

The Building Code of Australia (BCA) specifies that metal roofing systems must achieve a specific R-Value. This R-Value represents the efficiency of the insulation of the roofing. In particular, Section J of the BCA specifies that thermal insulation of roofing is important for the energy efficiency of the building i.e. the efficiency of the roof insulation is in direct correlation with the amount of energy expended on air conditioning. In order to reduce electricity expenditure, the BCA has outlined what R-Values must be met for certain roof types.

In the case of achieving an R-Value of 3.2, approximately 95-100 mm thickness glass wool building blanket is specified as having the adequate amount of thermal insulation to achieve this value. However, traditional roofing methods squash the roof sheet onto the glass wool and the insulation cannot recover to its full nominal thickness. This means that in practice, with traditional roofing materials commercially available, the R-Value of 3.2 may not be achieved using wool of approximately 95-100 mm thickness.

Attempts have been made to raise the roof sheet above a mounting purlin in order to achieve the maximum R-Value possible, however the applicant has identified that such attempts have created more problems and, specifically, have not solved the problem of fully compressing the wool between the roof sheet and the purlin by using the wool as a packer. Previously proposed systems utilise the height of the compressed wool between the purlin and the raising system to achieve the total height of approximately 95-100 mm.

Compressing the glass wool between the fastening point of the raising system and the purlin creates the following risks:

- Vibration and thermal expansion of the roofing arrangement could deteriorate the glass wool between the bracket and the purlin, over time. Compressed glass wool is not a structural material;
- Glass wool is not a consistent thickness or density across the one roll, or across manufacturers, the height achieved by using the compressed wool as a raising washer would be inconsistent; and
- Compression of the glass wool reduces the R-Value of the system (see FIG. 17).

The applicant has identified that there is not a commercially available solution on the market which contacts directly to the purlin, will achieve 100 mm height for all roofing profiles and will work in combination with all other commercially available roofing components.

Other problems created by raising the roof sheet include:

- Creating the need for the gutter to be raised also;
- Reducing the R-Value by compression of the wool atop the purlin; and
- Previously proposed systems cannot be supplemented with an additional component to be cyclone resistant.

The applicant has identified that it would be advantageous for there to be provided a product which satisfies the BCA when used in conjunction with currently available roofing products, for any R3.2 roofing situation.

In one existing arrangement for accommodating insulation beneath a roof sheet, the insulation is allowed to sag between the purlins to allow the building blanket to recover to its full nominal thickness (see FIG. 18). However, this arrangement is unsatisfactory as the building blanket is squashed between the roof sheet and the purlin, resulting in a large insulation efficiency loss where the wool is compressed. Also, the amount of sag cannot not be accurately measured, leaving a large margin for error, and the sag decreases the safety factor of the wire mesh beneath the wool. This method has been deemed by some to be less than optimal as it may cause safety risks and may produce poor results.

In another existing arrangement, a raiser bracket is mounted atop compressed glass wool insulation, as shown in FIG. 13. However, with this arrangement the fastening points sit atop the glass wool insulation utilising the compressed wool as a point of height raising, thus also resulting in a large insulation efficiency loss where the wool is compressed. Other disadvantages include that the raiser bracket is unsuitable for corrugated type roofing, and may be 5-10 mm under height if used for this purpose. Furthermore, the bracket must be assembled on site, does not suit the existing clips that roof sheet manufacturers sell with their roof sheeting, and is not rated for cyclonic regions. Also, the raiser bracket is only available in one height, creates problems for re-roofing (it raises the roof line, which in turn means the gutter must be raised to suit), and the length of the design suits the roofing clips, and not the insulation beneath it (insulation building blankets are typically 1200 mm wide).

In summary, the raiser bracket system shown in FIG. 13 involves a method of roofing not compatible with some existing components, and adds the inefficiency of pre-assembly.

Yet another existing arrangement for accommodating insulation beneath a roof sheet makes use of foam spacers. However these may have the following problems:

- Utilises the compressed wool beneath it as a point of height raising
- Does not attach to the purlin before the roof sheet is fixed. This creates the problem of the spacers sliding on a pitched roof or when the roof sheet is moved.
- Long screws without guides are required to fasten the roof sheet to the purlin, this creates the risk of screws not penetrating in a straight line
- Foam does not maintain its shape and thickness over time and under pressure as steel does
- Compresses the glass wool and detracts from the R-Value Existing arrangements may also have the problem of the support platforms being very narrow, making it difficult for roofing workers to balance when walking or kneeling on the brackets/purlins.

Examples of the invention seek to solve, or at least ameliorate, one or more disadvantages of previous roofing systems.

SUMMARY OF THE INVENTION

In accordance with one aspect of the present invention, there is provided a roofing support system including a spacer bracket having a lower edge adapted to pierce through a layer of insulation to abut in direct contact with a purlin, a fastener for fastening the spacer bracket to the purlin, and an upper portion adapted to support a beam above the insulation layer and in spaced relationship to the purlin.

Preferably, the fastener can include a fastener guide having a lower edge arranged to pierce through the insulation.

In a preferred example, the spacer bracket is formed of metal sheet bent at opposite ends to form tubular fastener guides. More preferably, the lower edge includes bottom edges of the fastener guides. The lower edge may also include an intermediate edge of the sheet between the fastener guides.

Preferably, the beam has substantially the same width as the purlin.

Preferably, the insulation layer is formed of glass wool.

Preferably, the beam is adapted for fixing a roof panel thereto.

Preferably, the beam has access apertures for accessing heads of fasteners extending through the fastener guides for driving the fasteners into the purlin with the heads of the fasteners below an upper support surface of the beam.

In accordance with another aspect of the present invention, there is provided a building support system including a spacer bracket having at one end an edge adapted to abut in direct contact with a support surface, a fastener for fastening the spacer bracket to the support surface, and at an opposite end, a portion adapted to support a beam/channel in spaced relationship to the support surface.

Preferably, the spacer bracket is adapted to support a wall panel or a floor panel, whereby the wall or floor panel is mounted to the beam/channel.

Preferably, the support surface is part of an additional beam/channel fixed to the spacer bracket, such that a beam/channel is fixed at each end of the spacer bracket, each beam/channel being fixed to the spacer bracket by way of fasteners extending into a fastener guide of the fastener.

Preferably, the spacer bracket is located relative to the beam/channel by a locating guide. More preferably, the locating guide has a movable guide part for limiting lateral movement of the locating guide relative to the beam/channel, the guide part being movable between a retracted condition suitable for broad beams/channels and an extended condition suitable for narrow beams/channels. In one form, the locating guide is coupled to the spacer bracket by tabs which are bent to interlock the locating guide and the spacer bracket.

In accordance with one aspect of the present invention, there is provided a method of installing a roofing panel including the steps of:

- laying a support sheet across roof purlins;
- laying an insulation layer on the support sheet;
- placing a spacer bracket on top of the insulation layer so that is it positioned above one of the purlins;
- applying force to the spacer bracket against the insulation layer toward the purlin so that a lower edge of the spacer bracket pierces through the insulation layer, the lower edge resting at or near the purlin;
- driving fasteners through fastener guides of the spacer bracket such that the spacer bracket is fastened to the purlin with the lower edge of the spacer bracket in direct contact with the purlin; and
- fastening the roofing panel to a beam mounted atop the spacer bracket, the beam being located above the insulation layer and in spaced relationship to the purlin.

Preferably, the method includes the step of fastening a plurality of spacer brackets at spaced locations along the purlin, with a lower edge of each spacer bracket in direct contact with the purlin, for supporting the beam above the insulation layer and in spaced relationship to the purlin.

Preferred examples of the invention include a beam in the form of a batten the same or similar width as the purlin, supporting screw guides that pierce through the wool and connect directly to the purlin, and a consistent height by virtue of the direct connection to the purlin. In practice, purlins differ in width, and the beam will preferably be in the form of a batten the same or similar width as the average purlin used in the application.

In short, it was the applicant's aim to create the effect of "raising the purlin". When the bracket is installed it gives the effect of having a fresh purlin to screw the roof sheet down onto.

BRIEF DESCRIPTION OF THE DRAWINGS

The invention is described, by way of non-limiting example only, with reference to the accompanying drawings in which:

FIG. 17 shows a table with values representing test results demonstrating improved thermal performance through use of examples of the invention.

DETAILED DESCRIPTION

Figure 1:
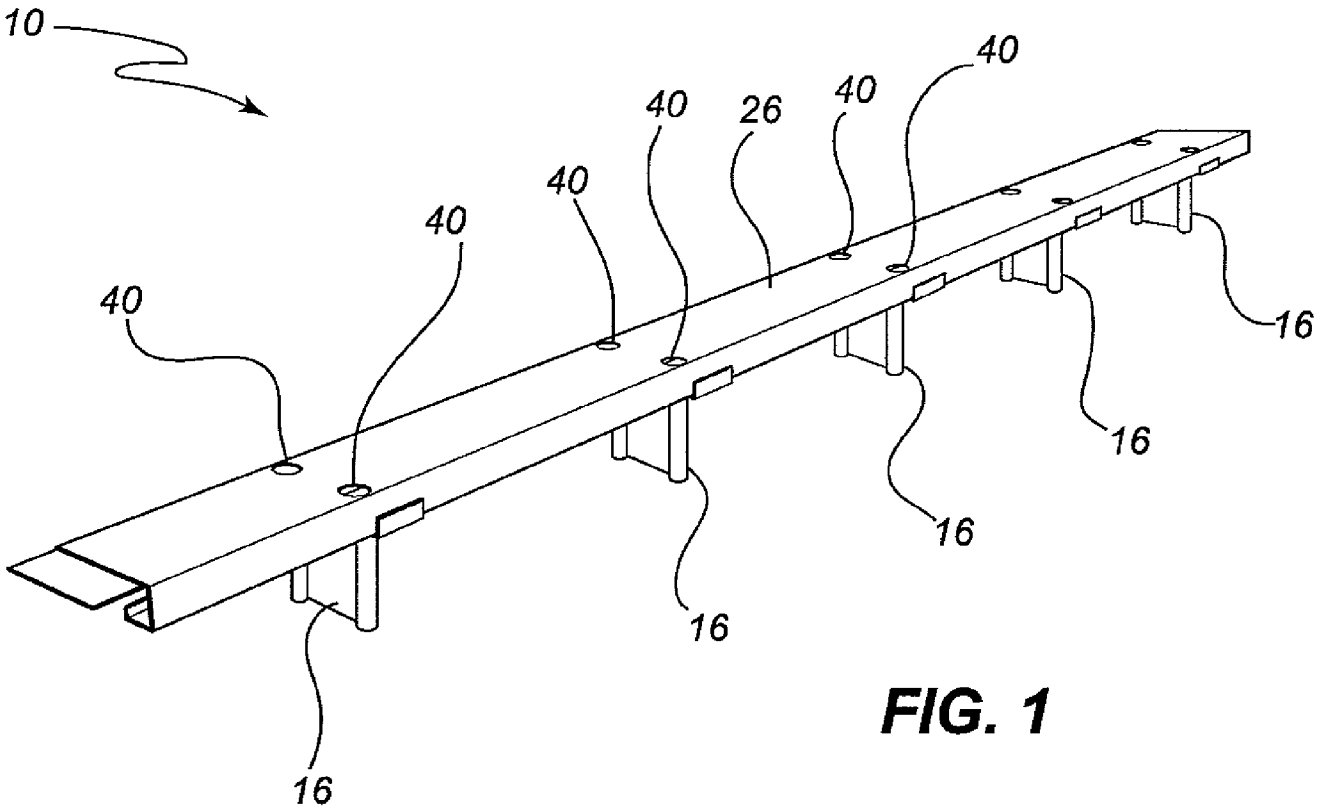
FIG. 1 is a side perspective view of a roofing support system in accordance with an example of the present invention.
Figure 2:
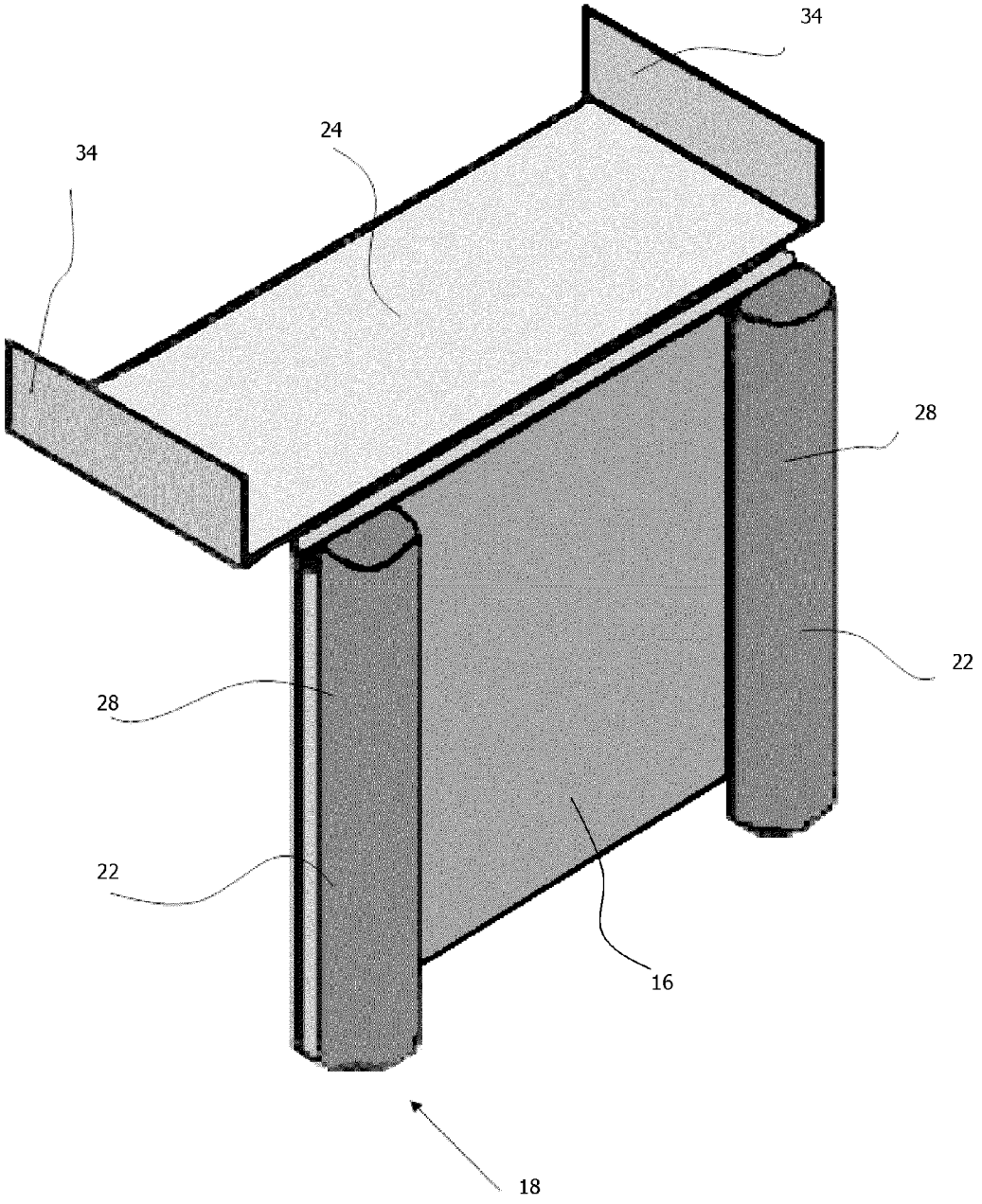
FIG. 2 is a detailed perspective view from one side of a support bracket of the roofing support system.
Figure 3:
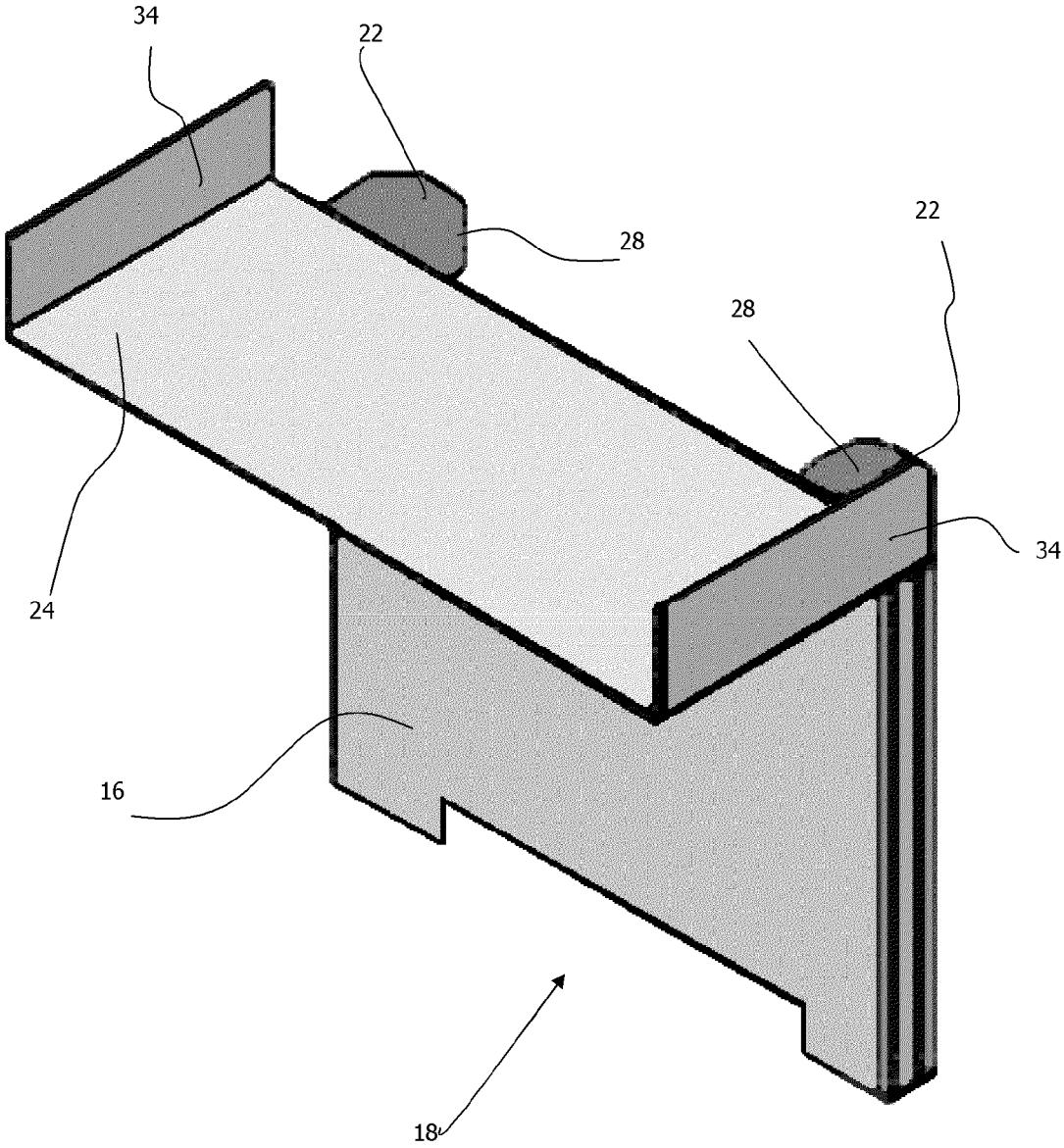
FIG. 3 is a detailed perspective view of the other side of the support bracket shown in FIG. 2.
Figure 4:
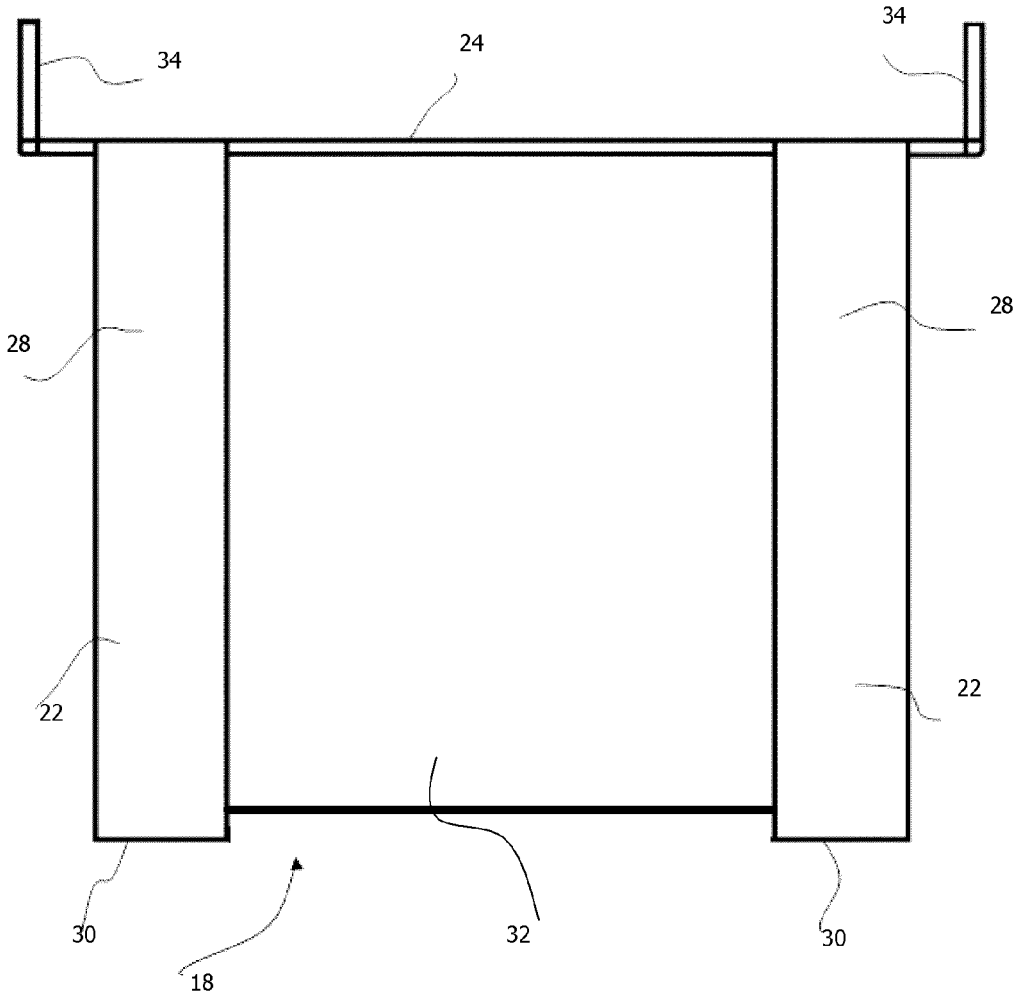
FIG. 4 is a front view of the support bracket.
Figure 5:
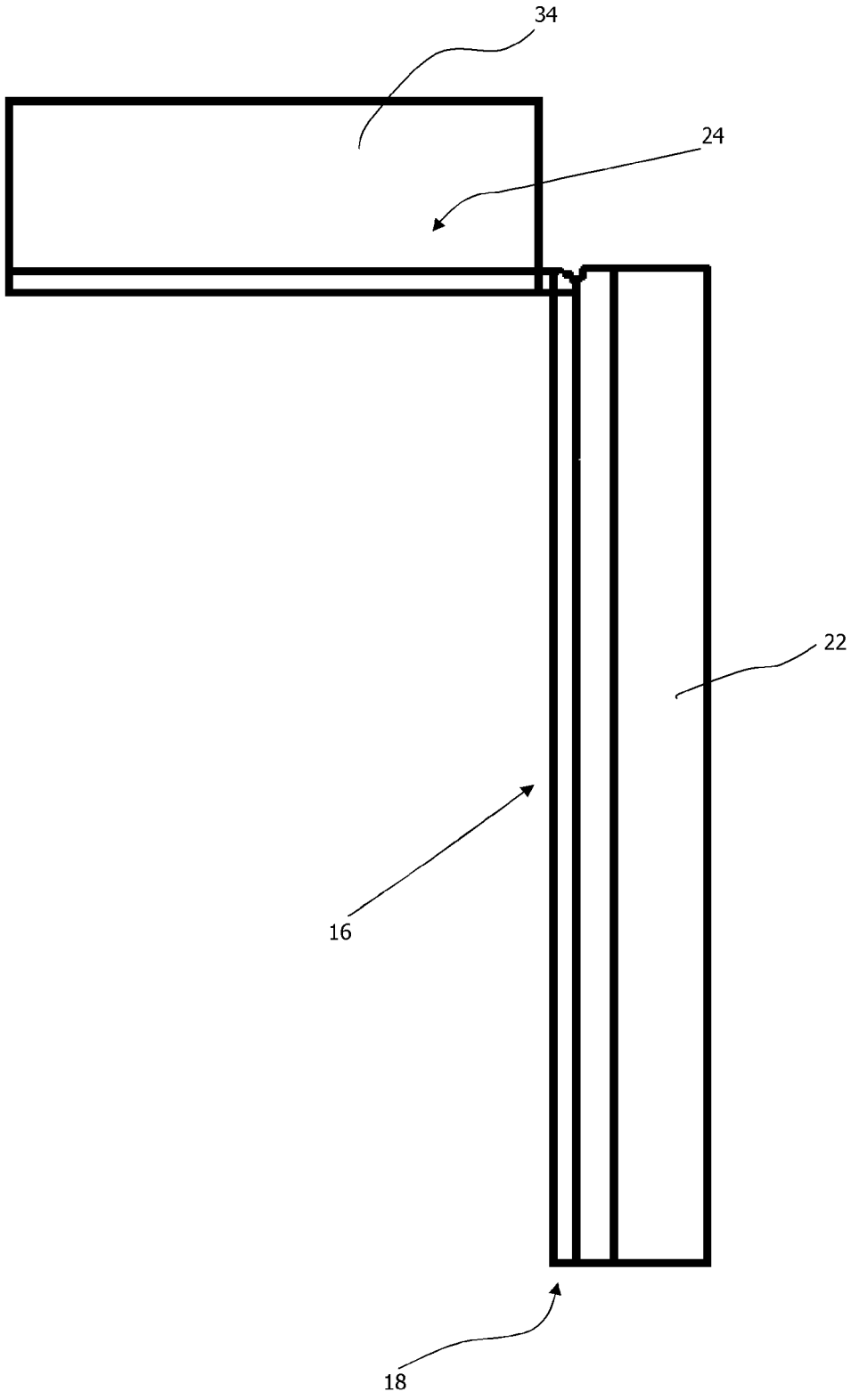
FIG. 5 is a side view of the support bracket.

With reference to FIG. 1, there is shown a roofing support system 10 for supporting a roofing panel 12 above an insulation layer 14. Advantageously, the roofing support system 10 enables the insulation layer 14 to remain substantially uncompressed such that its effectiveness is maximised, thus improving energy efficiency. The roofing support system 10 minimises compression of the insulation layer 14 by avoiding using the insulation layer 14 as a structural component, as has been done in previously proposed roofing support systems (see for example FIG. 13).

Figure 12:
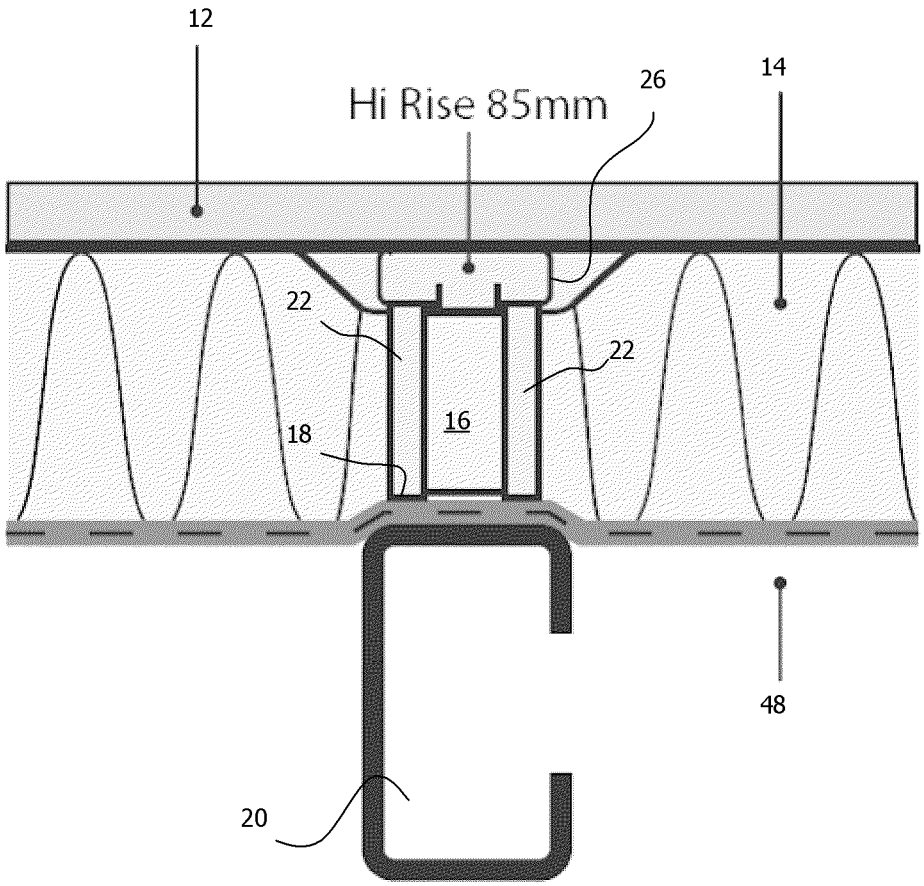
FIG. 12 is a diagrammatic cross-sectional view showing an example of the invention in use.

The roofing support system 10 according to the present invention includes a spacer bracket 16, as shown in detail in FIGS. 2 to 8. The spacer bracket 16 has a lower edge 18 adapted to pierce through the insulation layer 14 to abut in direct contact with a purlin 20, as shown in FIG. 12. The roofing support system 10 also includes a fastener 22 for fastening the spacer bracket 16 to the purlin 20, and an upper portion 24 adapted to support a beam 26 above the insulation layer 14 and in spaced relationship to the purlin 20.

Figure 13:
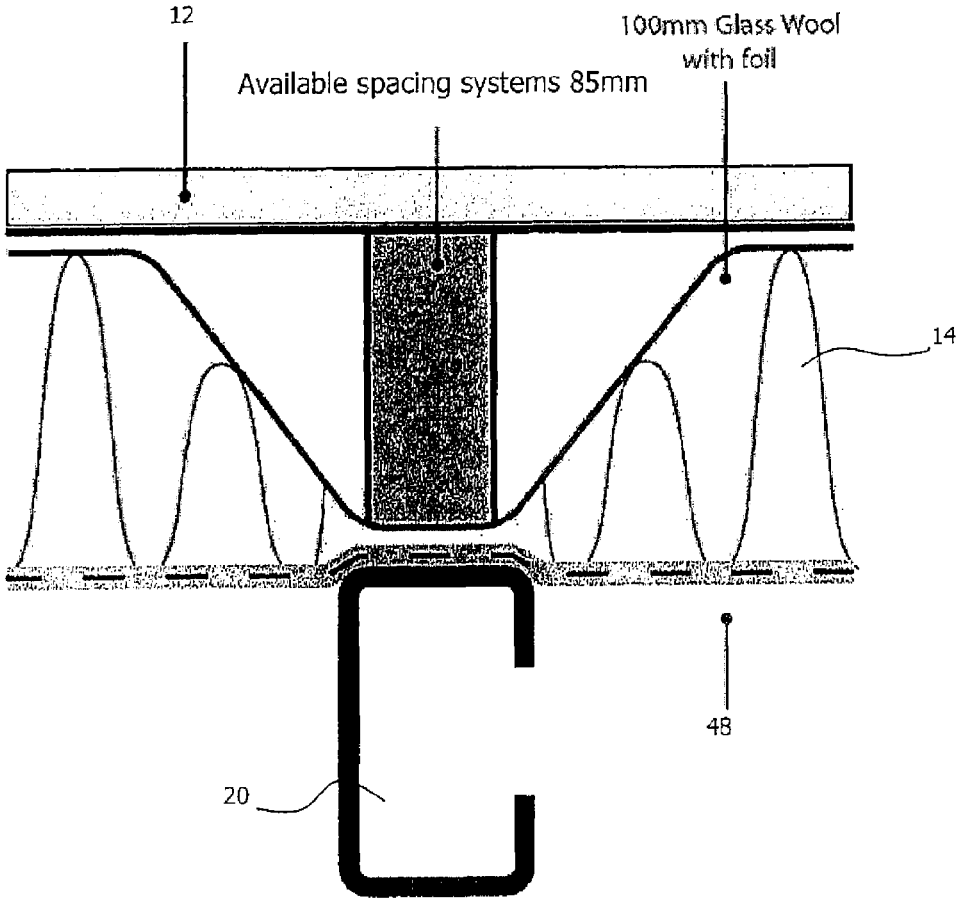
FIGURE 13 PRIOR ART
FIG. 13 is a diagrammatic cross-sectional view showing a previously proposed roofing support system in use.

Advantageously, as the lower edge 18 of the spacer bracket 16 pierces through the insulation layer 14 and abuts in direct contact with the purlin 20, vertical loading on the spacer bracket 16 is transferred directly to the purlin 20, in contrast to the arrangement shown in FIG. 13 wherein vertical loading is transferred to the purlin 20 via the insulation layer 14. In this way, compression of the insulation layer 14 is substantially avoided, and the thermal effectiveness of the insulation layer 14 is maximised through maintaining the layer in its substantially uncompressed form.

The fastener 22 can include a fastener guide 28 at each side of the spacer bracket 16, each of the fastener guides 28 having a bottom edge 30 arranged to pierce through the insulation layer 14. The spacer bracket 16 is formed of metal sheet which, as shown in the top view of FIG. 8, may be bent at opposite ends to form the tubular fastener guides 28. The lower edge 18 includes the bottom edges 30 of the fastener guides 28, with a recessed intermediate edge 32 of the sheet located between the fastener guides 28. The bottom edges 30 of the fastener guides 28, and the intermediate edge 32 may all be formed by a single edge of the metal sheet from which the spacer bracket 16 is formed.

Figure 6:
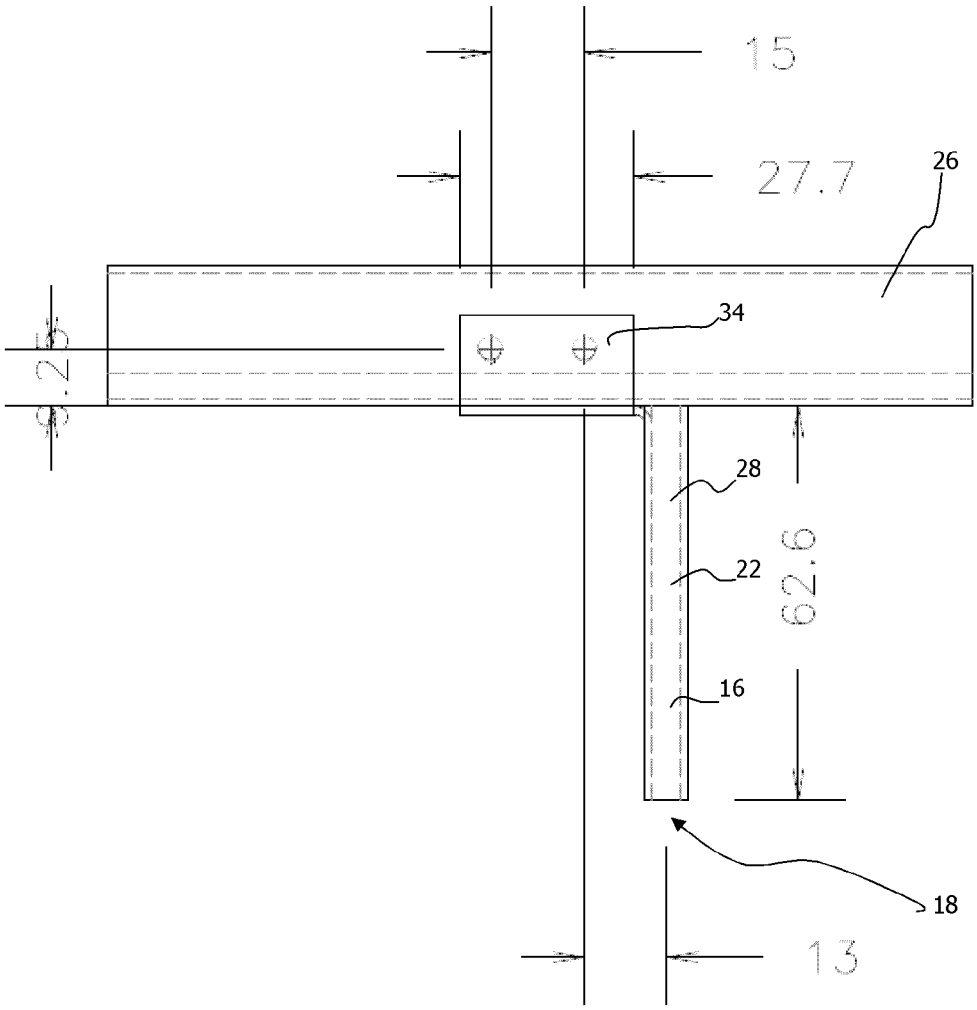
FIG. 6 is a side view of the support bracket, shown supporting a roofing beam.
Figure 7:
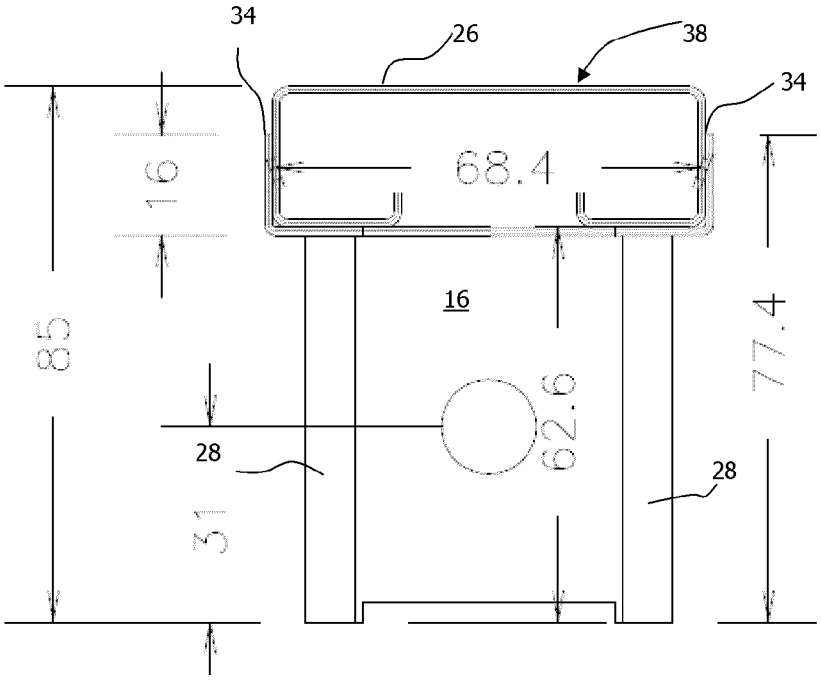
FIG. 7 is a front view of the support bracket, shown supporting the roofing beam.
Figure 8:
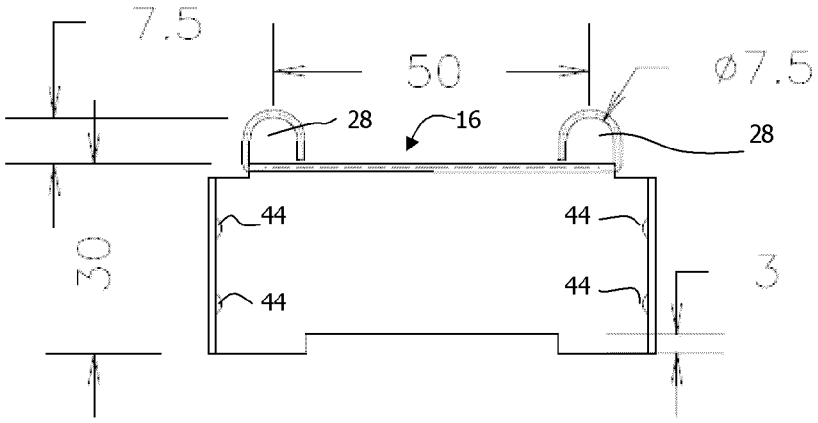
FIG. 8 is a top view of the support bracket.
Figure 9:
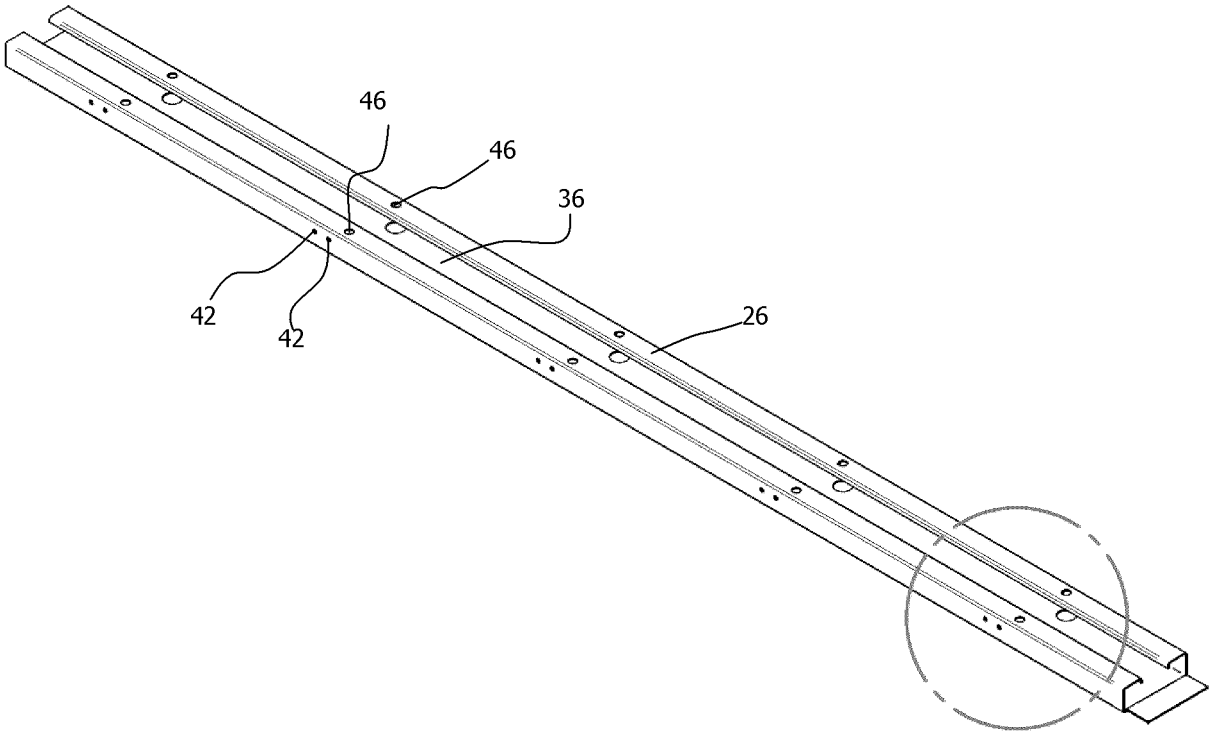
FIG. 9 is a perspective underside view of the roofing beam.
Figure 10:
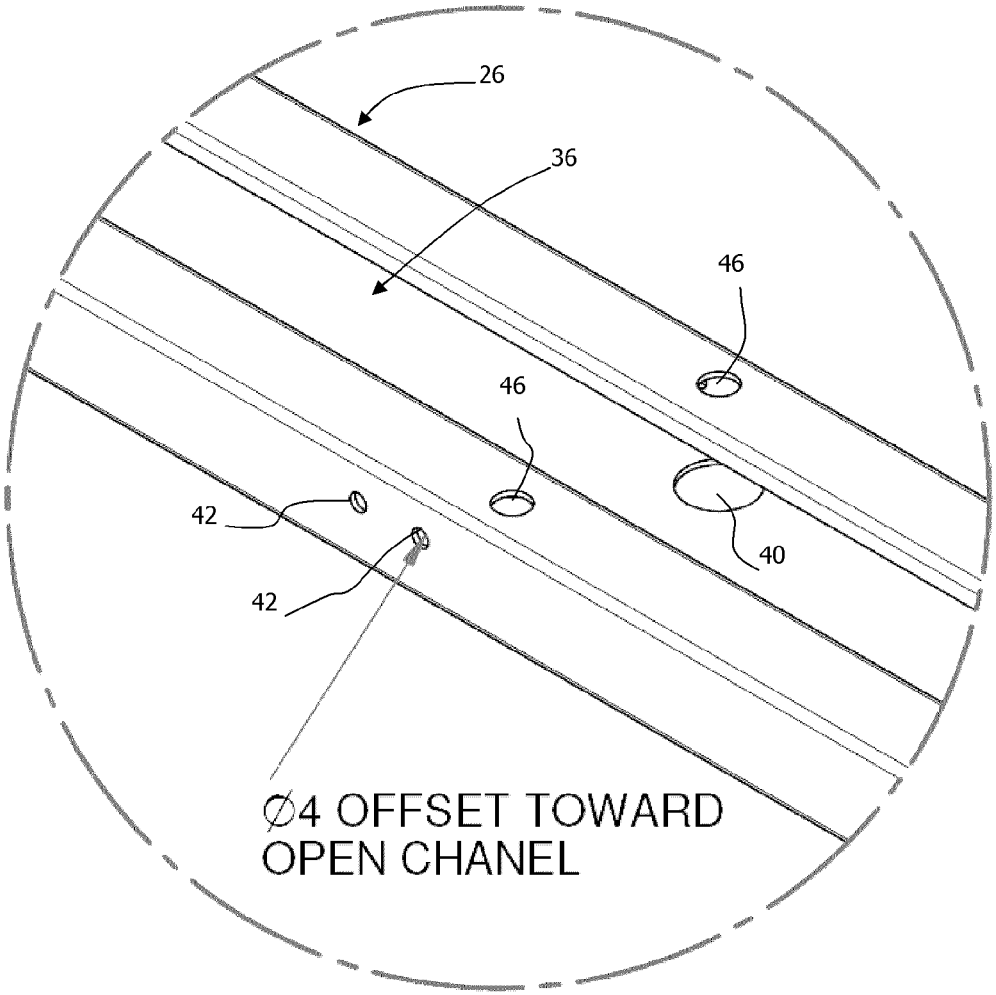
FIG. 10 is a detailed view of a section of the roofing beam shown in FIG. 9.
Figures 11A, 11B, 11C:
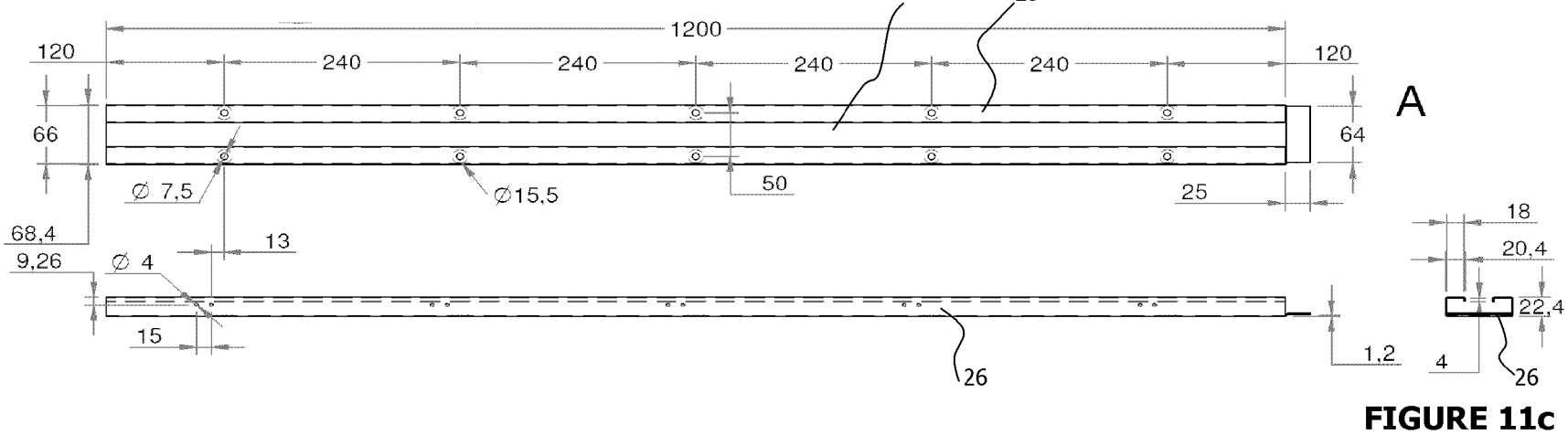
FIG. 11*a* is an underside view of the roofing beam.
FIG. 11*b* is a side view of the roofing beam.
FIG. 11*c* is an end view of the roofing beam.

The spacer bracket 16 has vertical flanges 34 at either side of the upper portion 24 to assist in holding the beam 26 on the upper portion 24. As shown in FIGS. 6 and 7, the vertical flanges 34 positively locate the beam 26 relative to the spacer bracket 16. The beam 26 may be formed as a C-section batten, as shown in FIGS. 7, 9 and 11*c*. The beam 26 is oriented with an open channel 36 facing downwardly such that a flat upper support surface 38 is oriented for attaching the roofing panel 12 thereto. The beam 26 is provided with access apertures 40 for accessing heads of fasteners extending through the fastener guides 28, such that the fasteners can be driven into the purlin 20 with the heads of the fasteners below the upper support surface 38 of the beam 26. As shown in the detail of FIG. 10, the beam 26 may also have locating apertures 42 for receiving indents 44 of the spacer bracket 16 to assist with location of the spacer brackets 16 along the length of the beam 26. Fastening apertures 46 are located at an underside of the beam 26, and abut with the heads of the fasteners such that the beam 26 and the spacer bracket 16 are both held in place relative to the purlin 20 by the fasteners.

With reference to FIG. 7, the intermediate edge 32 may be recessed above the bottom edges 30 of the fastener guides 28 so as to leave a gap or window between the intermediate edge 32 and the roof purlin 20 when installed (see FIG. 12). In an example, this gap may be 1.2 mm. Advantageously, the gap creates a thermal break wherein only the bottom edges 30 of the fastener guides 28 contact the purlin 20. Further, the gap may be advantageous in not severing safety wires if by chance they are trapped between the spacer bracket and the purlin 20.

Accordingly, by way of the present invention, the roofing panel 12 is able to be installed by firstly laying a support sheet 48 of roofing safety mesh across the roof purlins 20, laying the insulation layer 14 across the support sheet 48, then by placing the spacer brackets 16 on top of the insulation layer 14 such that they are positioned above one of the purlins. Force is applied to each of the spacer brackets 16 against the insulation layer 14 toward the purlin 20 so that the lower edges 18 of the spacer brackets 16 pierce through the insulation layer 14, the lower edges 18 resting at or near the upper surface of the purlin 20. Fasteners are then driven through the fastener guides 28 by using a tool which accesses the fasteners through the access apertures 40. In this way, the fasteners are tightened such that the spacer brackets 16 are fastened to the purlin 20 with the lower edges 18 of the spacer brackets 16 in direct contact with the purlin 20. The roofing panel 12 is then fastened to the beam 26 mounted atop the spacer brackets 16, the beam 26 being located above the insulation layer 14 and in spaced relationship to the purlin 20.

In examples of the invention, the beam 26 has substantially the same width as the purlin 20, assisting with the effect of raising the purlin 20. Accordingly, for each purlin 20 a single beam 26 will be mounted above the purlin 20 and in parallel to the purlin 20, with a plurality of support brackets 16 supporting the beam 26.

Example

(i). The Fixing Batten

This batten is the full width of a purlin (68.4 mm external) and is fabricated in such a way that the fixing screws do not protrude above the top surface of the batten. The fixing points are hidden, but also accessible. This means that the roof sheet can sit directly onto the batten, as there are no screw heads protruding. There are current methods of recessing the fixing points, however, these current methods detract from the total width of the top surface.

The batten design allows for optional fixing arrays—different fixing arrays can be used for different wind regions. As there are four wind regions (A, B, C and D) as specified by the BCA, fewer screws can be used for regions A and B, saving time and materials.

Batten Properties:

550 MPa 1.15 mm thick galvanised steel. Z275 coating
1225 total length, 1200 mm total length when paired
68.4 mm total external width
22.4 mm total external height

(ii). The Vertical Screw Guides

The vertical screw guides are custom designed, and allow the batten to be raised above the glass wool with fixing screws passing through the wool into the purlin without compromising the structural integrity of the arrangement. The guides act as a washer that when fixed to the purlin hold the three components together securely (the batten, the guides and the purlin).

The vertical screw guides are fixed to the batten during manufacturer's assembly so that no on-site assembly is needed.

Material properties: 1.15 mm thick G300 galvanised steel, Z275 coating. Raises batten by 62.6 mm How to implement the design:

1. As per manufacturers instructions, wire safety mesh is laid across the purlins
2. As per manufacturers instructions, 100 mm foil faced building blanket is laid on top of the safety mesh Up until this point, nothing has changed in the regular roofing process 3. The bracket is placed on top of the building blanket so that is it positioned in the middle of the purlin beneath it. The purlin will be visible at the end of the building blanket. In the case of the first bracket, the purlin will also be visible at the beginning of the building blanket.

4. With a back and forwards motion, applying slight downwards pressure, by hand, the vertical legs of the bracket will part the wool beneath it and sink down onto the purlin.

5. Once the bracket has made contact, or near contact with the purlin, 100 mm fixing screws can be placed into the 'tubular arcs' of the vertical screw guides, via the 'window holes' on top of the batten. If the vertical guides are not sitting directly on the purlin this is not a problem, once screwed into the purlin the vertical guides will make direct contact.

Note that the screws can be pre-loaded into the tubular arcs before step 3, if preferred.

6. Use the number of screws specified for the wind region (recommendations from structural engineer to be advised).

7. Using a roofing screw gun, fasten one screw at one end, check the bracket is still aligned on the purlin, and fasten a second screw.

It is recommended to use part body weight on one foot, on the batten, to hold it in place. This will also allow the installer to reach further to the end screws.

8. Fasten the remaining screws

Installation complete. There will now be the effect of a purlin sitting on top of the glass wool.

9. Continue the roofing process as usual, per manufacturers instructions.

The vertical screw guides are the crux of the design. This is what allows a batten to sit above the glass wool insulation, and be fixed directly to the purlin, without compressing the wool critically.

Advantageously, the bracket fastens directly to the purlin by passing through the glass wool. The example of the invention shown in the drawings acts as another purlin, gives the same surface area as the purlin beneath it for fixing and foot traffic, and also fastens securely to the purlin so that with thermal expansion and contraction the bracket will transfer any movement directly to the purlin. In the example, the fixings of the brackets are horizontally opposed, such that they are more robust and less likely to loosen than previously proposed arrangements which have a single central fixing. The applicant has determined that single central fixings leave the brackets subject to being loosened from the purlin if rocked.

Use of the bracket does not change current roofing methodology, there is no pre-assembly required, and existing manufacturer's roofing clips can be used. The example of the invention depicted is able to achieve the 100 mm height for all roofing profiles, and is easily converted into a cyclone rated assembly with the addition of a separate tailored washer. As will be appreciated, the invention achieves minimal squashing of the glass wool between it and the purlin. Although in tests the bracket compressed a 100 mm layer of glass wool down to 62.6 mm, it compensated with a 20 mm unventilated air gap above it. Not only does this solution have the least amount of compression, but it does not use the compressed wool as support or as a point of height raising.

The roofing system can be adjusted at the point of manufacture, or on site, for variable height to suit re-roofing situations. Adjustment can also be made at the point of manufacture, or on site, to suit building blankets of smaller nominal thickness. The roofing system may be dimensioned to suit the building blanket width, i.e. the bracket may be 1200 mm long where the building blanket is 1200 mm wide.

Advantageously, existing roofing methods can be adapted for using the insulation spacer of the present invention so as to obtain improved insulation and energy efficiency.

While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments.

For example, other battens can be used with the vertical screw guide bracket, however, they may not perform as efficiently. Other shapes of batten may not allow for the large flat surface on the top of the batten with the same degree of strength. In variations, the vertical screw guide bracket can be slightly varied so that it attaches to the batten in a different manner, or at a different fastening point.

In alternative examples of the present invention, the support system may be in the form of a building support system for supporting a wall panel or a floor panel relative to a support surface. More specifically, with regard to FIG. 14, there is shown a building support system 100 including a spacer bracket 102 having at one end 104 an edge 106 adapted to abut in direct contact with a support surface 108. The support surface 108 may be in the form of a lower floor or wall layer. An opposite end 110 has a portion 112 adapted to support a beam/channel 114 in spaced relationship to the support surface 108. A raised wall or flooring panel (or membrane) 116 is mounted to the beam/channel 114. More specifically, the raised wall or flooring panel 116 may be fixed to the beam/channel 114 by way of appropriate fasteners.

The fastener of the building support system 100 can include fastener guides 118 through which fasteners 120 extend so as to fix the spacer bracket 102 to the support surface 108.

Figure 14:
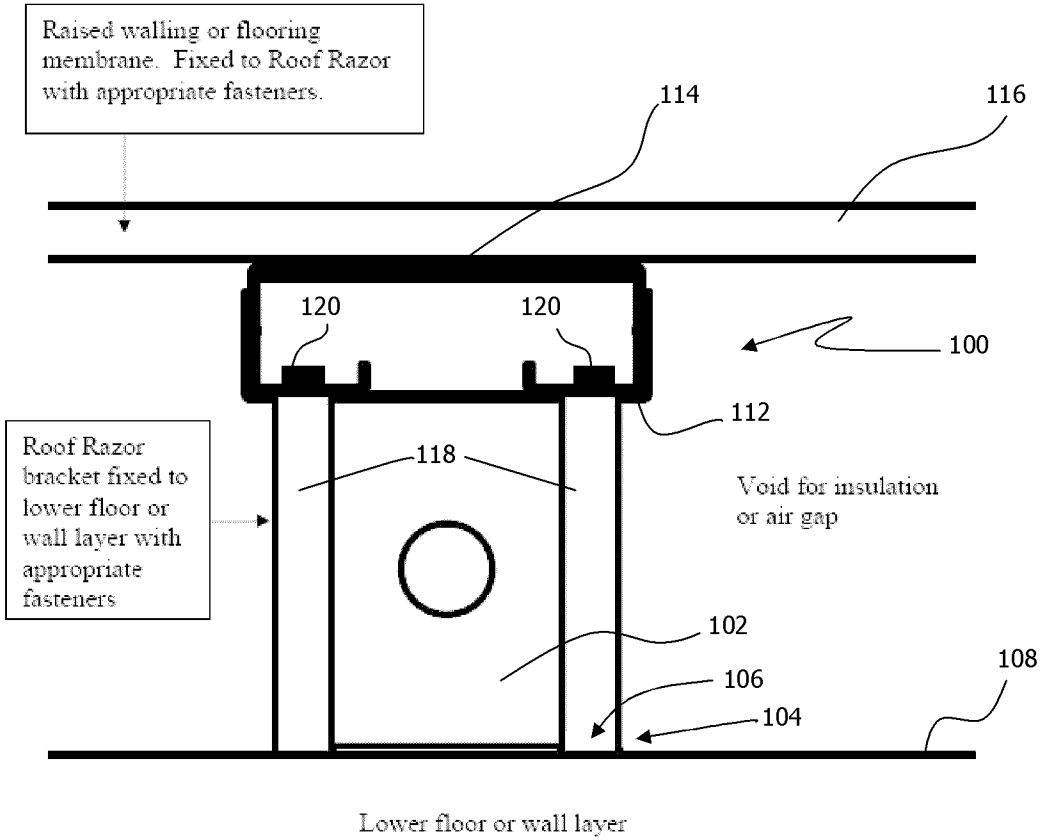
FIG. 14 is a diagrammatic cross-sectional view showing an example of the invention in use in supporting a raised wall or flooring membrane.

By using the building support system 100 as shown in FIG. 14, there is provided a void between the support surface 108 and the raised wall or flooring panel 116 for insulation or an air gap.

Figure 15:
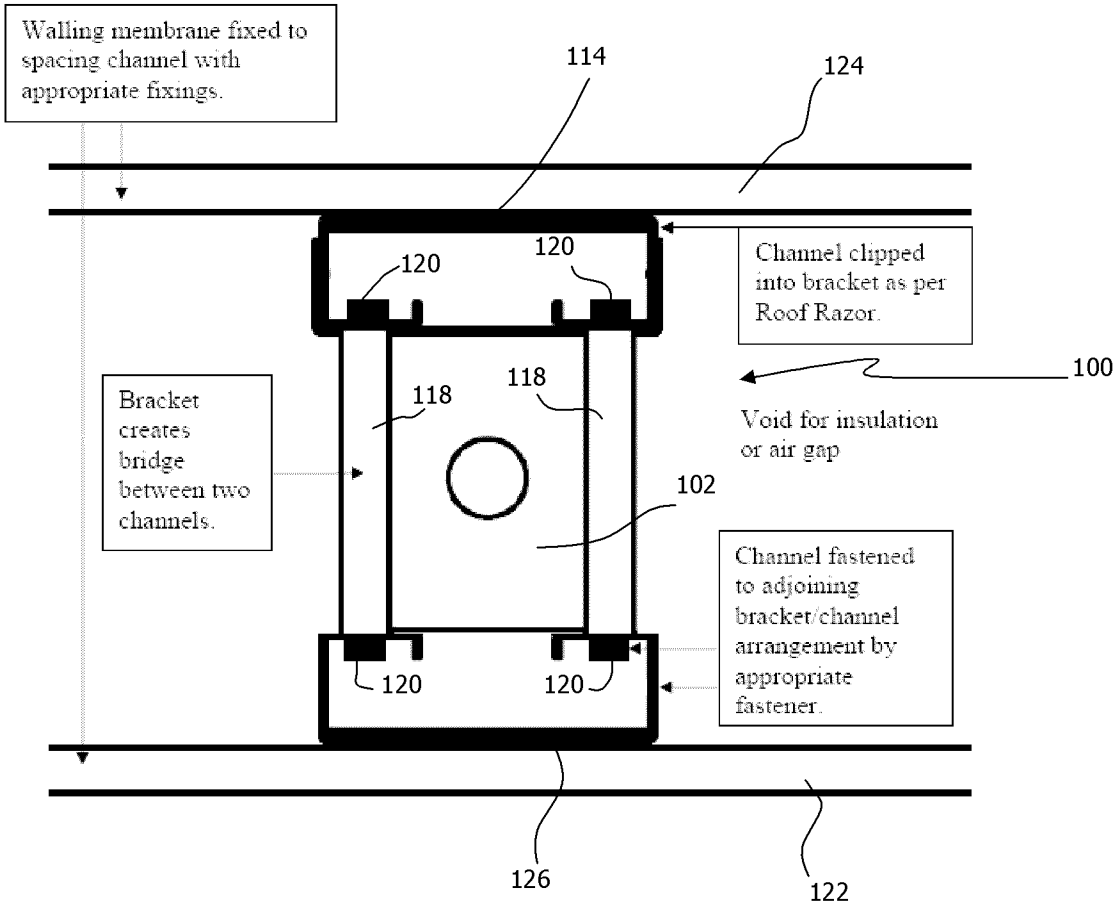
FIG. 15 is a diagrammatic cross-sectional view showing an example of the invention in use supporting a wall membrane relative to another wall membrane.

FIG. 15 shows an alternative example of the present invention in which the building support system 100 is used to create a void for insulation or an air gap between two opposed wall panels (or membranes) 122, 124. Accordingly, the same spacer bracket 102 as is used in FIGS. 1 to 14 may be utilised, except in that the support surface 108 is part of an additional beam/channel 126 fixed to the spacer bracket 102. Accordingly, a beam/channel 114, 126 is fixed at each end of the spacer bracket 102, each beam/channel 114, 126 being fixed to the spacer bracket 102 by way of fasteners 120 extending into respective fastener guides 118 of the fastener.

Each of the opposed wall panels 122, 124 is fixed to the respective beam/channel 126, 114 with appropriate fixings. The spacer bracket 102 effectively creates a bridge between the beams/channels 114, 126, and the fasteners 120 may be simply in the form of a nut and bolt combination extending through each of the fastener guides 118. The beam/channel 114 is clipped into the spacer bracket 102 as in the arrangements shown in FIGS. 1 to 14, whereas the beam/channel 126 is fastened to the adjoining spacer bracket 102 and beam/channel 114 by way of the fasteners 120.

FIGS. 16*a* to 16*d* demonstrate the addition of a locating guide tool 128 in the form of a 'wing clip' adaptor which clips onto the existing upright legs of the spacer bracket 102. The locating tool 128 centres the spacer bracket 102 atop the purlin 20 in circumstances where the top surface of the purlin 20 is very narrow and does not allow for much margin for error. This locating tool 128 reduces that margin for error. Additionally this locating tool 128 has a movable guide wing 130 that can be bent back when the purlin 20 width changes on the same run. As it is common in roofing, the Z purlins are overlapped in such a way that the biggest flange meets the smallest flange and there may be a difference in width of up to 15 mm.

Figure 16A:
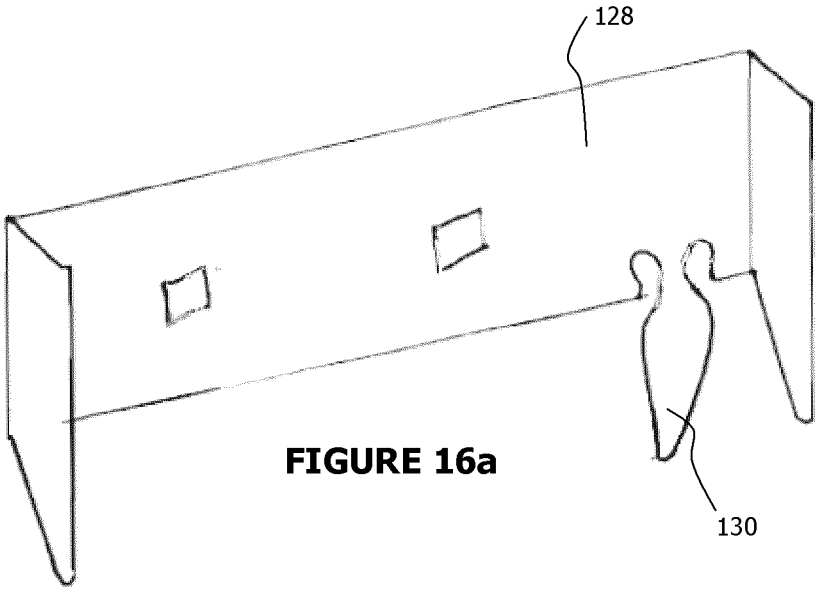
FIGS. 16*a* to 16*d* show a locating guide for use in locating a support bracket relative to a beam/channel, in accordance with an example of the present invention.
Figure 16B:
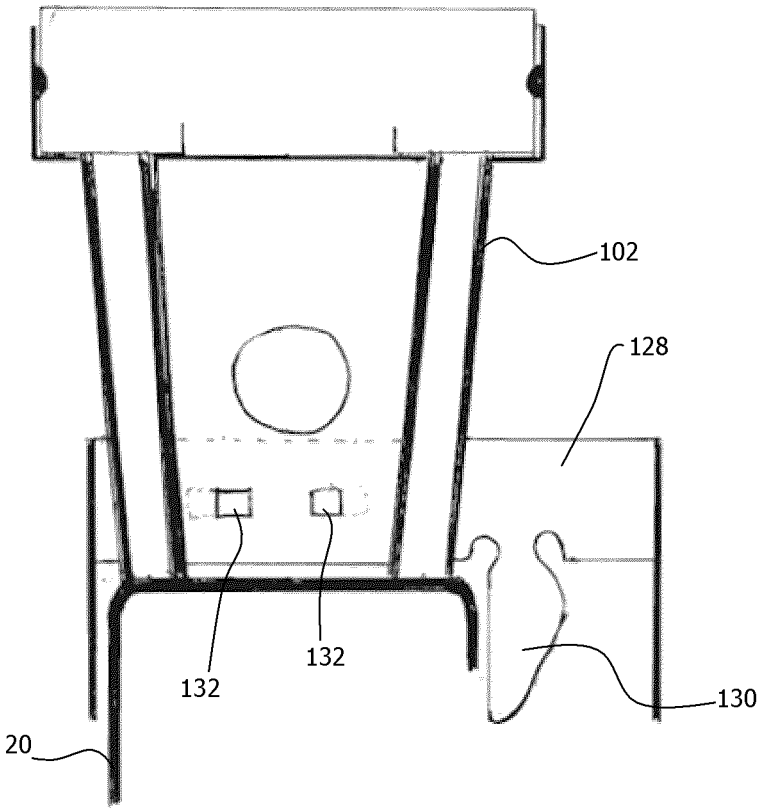

FIG. 16*b* shows the locating tool 128 in use on a relatively narrow purlin 20, wherein the movable guide wing 130 is retained in a substantially vertical orientation so as to extend downwardly to one side of the purlin 20. The locating tool 128 is fastened to the spacer bracket 102 by locating lugs 132. The locating lugs 132 may be in the form of two locating/fixing lugs formed on the spacer bracket 102 that are bent back over the locating tool 128 to hold it in place. The locating tool 128 facilitates ease of installation of the spacer bracket 102, and may be used as an optional extra in situations where the purlins are particularly narrow.

Figure 16C:
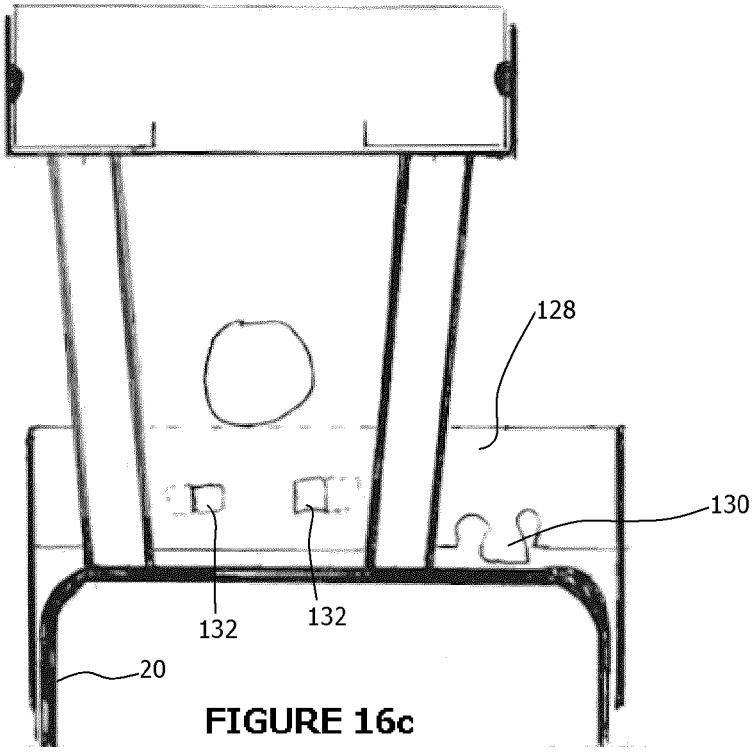
Figure 16D:
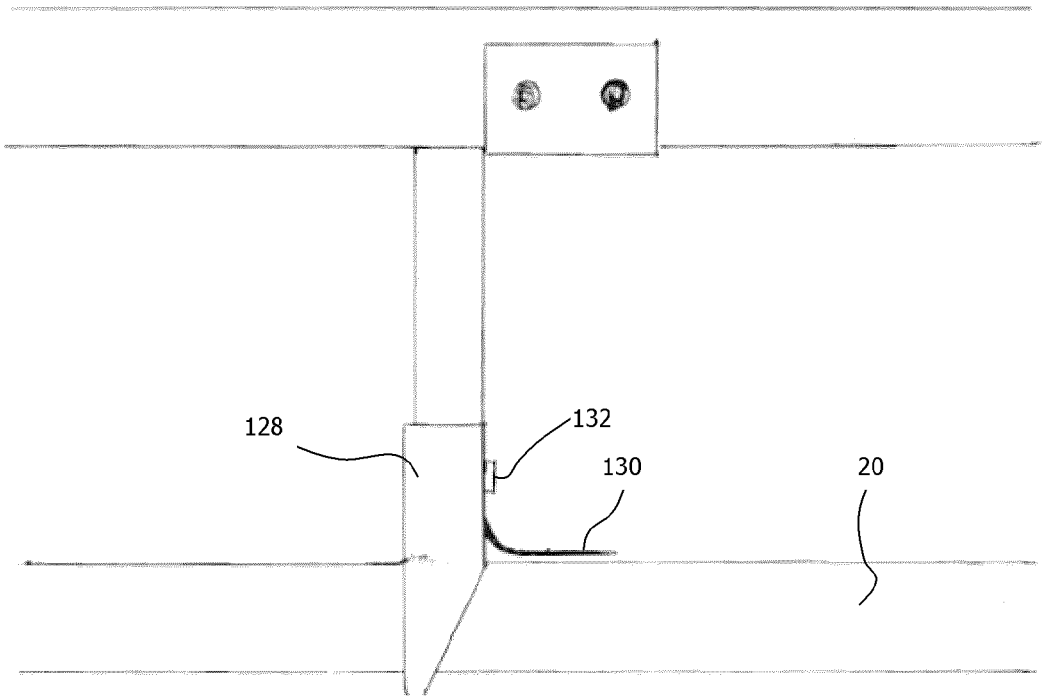

FIG. 16*c* shows the locating tool 128 in use on a relatively broad purlin 20, wherein the movable guide wing 130 is bent into a substantially horizontal configuration so as to lie generally parallel to the upper surface of the purlin 20. FIG. 16*d* shows a side view of the arrangement of FIG. 16*c*, illustrating the movable guide wing 130 lying above the purlin 20.

Figure 18:
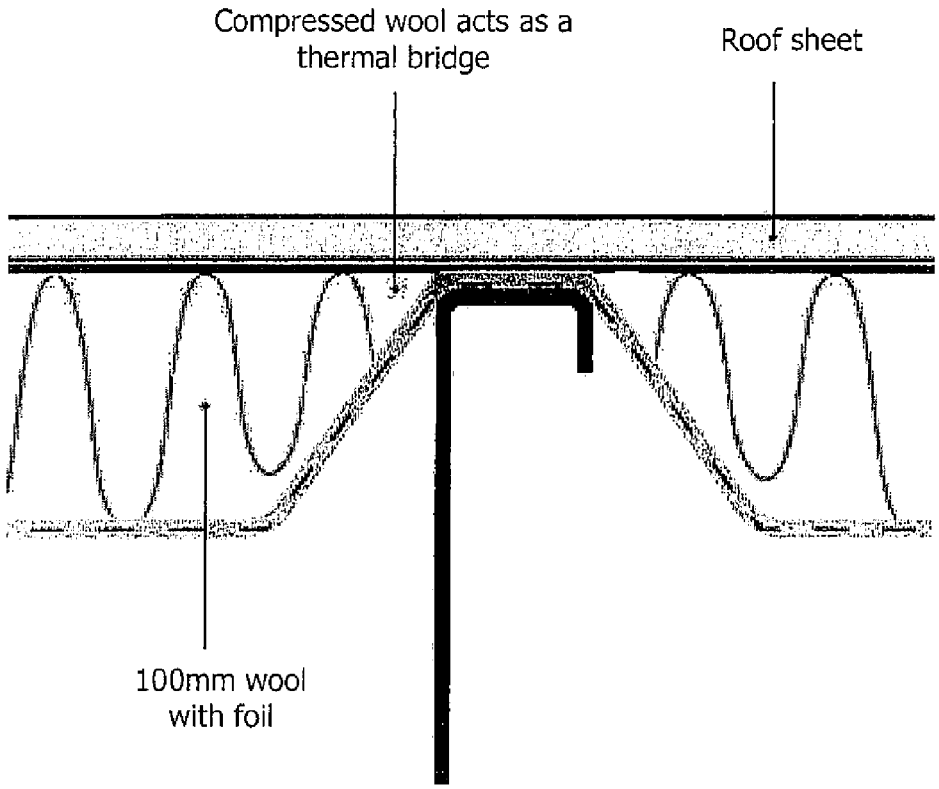
FIGURE 18 PRIOR ART
FIG. 18 shows sagging or 'dishing' of safety mesh in a previously proposed insulation arrangement.

FIG. 17 shows a table with values representing test results demonstrating improved thermal performance through use of examples of the invention. A report has been produced on the thermal performance of two examples of the present invention, referred to as "Roof Razor" and "Roof Razor C3". The report modelled the thermal performance of the Roof Razor as a roofing system with respect to reductions in total R-Value due to thermal bridging. Two other systems are modelled in comparison—using no spacer, and using a pine raising block. Where no spacer is used, the safety mesh may sag or 'dish', as shown in FIG. 18, such that the compressed wool acts as a thermal bridge.

The key results are shown in FIG. 17. The low conductivity of the present invention can be attributed to the tiny amount of surface are contact between the spacer bracket and the supporting metal frame. Losses in other methods are attributed to thermal bridging by way of compressing the glasswool insulation at the join. The table in FIG. 17 reflects systems incorporating R2.5 glasswool building blanket at 100 mm nominal thickness, bonded on its underside with reflective foil.

Thermal breaks, as defined in the relevant Building Codes of Australia (BCA), must be equal to or greater than R0.2. Compressing glasswool insulation directly onto metal frames does not satisfy the BCA requirements for thermal breaks.

The report concluded that for an example insulated warehouse roof, the calculations revealed compression of insulation blanket reduces overall Total R by 39%, but by using the Roof Razor, the compression may be eliminated such that the overall Total R reduction is only 1%. The calculations verified that the Roof Razor systems (Standard and Cyclonic) almost eliminate Total R reduction due to thermal bridging from insulation compression.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

What is claimed is:

1. A roofing system comprising:

a purlin;

a support sheet laid on top of the purlin;

a layer of insulation disposed on the support sheet;

a plurality of spacer brackets, the spacer brackets being formed from a metal sheet defining a first portion having a lower edge adapted to part the layer of insulation to abut in direct contact with the purlin, the metal sheet being bent at opposed ends of the first portion to define integral tubular fastening guides, and an upper portion adapted to support a beam above the insulation layer and in spaced relationship to the purlin, wherein the upper portion is also integrally formed from the same metal sheet as the first portion, and wherein the tubular fastening guides define open upper ends adjacent the upper portion for receiving fasteners configured to fasten the spacer brackets to the purlin;

wherein the plurality of spacer brackets are mounted on top of the purlin and support sheet with the lower edge of the brackets in contact with the support sheet wherein fasteners pass through the tubular fastening guides and fasten the spacer brackets to the purlin.

2. A roofing system as claimed in claim 1, wherein the lower edge comprises bottom edges of the fastener guides.

3. A roofing system as claimed in claim 2, wherein the lower edge further comprises an intermediate edge of the sheet between the fastener guides.

4. A roofing system as claimed in claim 1, wherein the beam has substantially the same width as the purlin.

5. A roofing system as claimed in claim 1, wherein the insulation layer is formed of glass wool.

6. A roofing system as claimed in claim 1, wherein the beam is adapted for fixing a roof panel thereto.

7. A roofing system as claimed in claim 1, wherein the beam has access apertures for accessing heads of fasteners extending through the fastener guides for driving the fasteners into the purlin with the heads of the fasteners below an upper support surface of the beam.

8. A roofing system as claimed in claim 1, wherein the spacer brackets have upper edges, which define two opposed flanges, which extend substantially vertically and are configured to receive the beam there between.

9. A roofing system as claimed in claim 1 wherein the upper portion is formed by bending the metal sheet and wherein the upper portion is disposed to one side of the tubular fastening guides and does not extend above the tubular fastening guides.

10. A method of installing a roofing panel comprising:

(a) laying a support sheet across roof purlins;

(b) laying an insulation layer on the support sheet; and (c) installing the roofing support system of claim 1 comprising the steps of:

(i) placing the spacer bracket on top of the insulation layer so that is it positioned above one of the purlins;

(ii) applying force to the spacer bracket against the insulation layer toward the purlin so that a lower edge of the spacer bracket pierces through the insulation layer, the lower edge resting at or near the purlin;

(iii) driving the fastener through a fastener guide of the spacer bracket such that the spacer bracket is fastened to the purlin with the lower edge of the spacer bracket in direct contact with the purlin; and (iv) fastening the roofing panel to a beam mounted atop the spacer bracket, the beam being located above the insulation layer and in spaced relationship to the purlin.

11. A method of installing a roofing panel as claimed in claim 10, further comprising fastening a plurality of spacer brackets at spaced locations along the purlin, with a lower edge of each spacer bracket in direct contact with the purlin, for supporting the beam above the insulation layer and in spaced relationship to the purlin.

* * * * *